US007549702B2

(12) United States Patent
Meyers

(10) Patent No.: US 7,549,702 B2
(45) Date of Patent: Jun. 23, 2009

(54) FOLDABLE BATH SEAT

(75) Inventor: Daniel Seth Meyers, Roxboro (CA)

(73) Assignee: AMG Medical Inc., Montreal, Quebec (CA)

( * ) Notice: Subject to any disclaimer, the term of this patent is extended or adjusted under 35 U.S.C. 154(b) by 126 days.

(21) Appl. No.: 11/741,869

(22) Filed: Apr. 30, 2007

(65) Prior Publication Data

US 2008/0263760 A1 Oct. 30, 2008

(51) Int. Cl.

| | |
|---|---|
| ***A47K 3/022*** | (2006.01) |
| ***A47C 4/00*** | (2006.01) |
| ***A45C 1/00*** | (2006.01) |
| ***A47C 7/62*** | (2006.01) |
| ***A47C 7/02*** | (2006.01) |

(52) U.S. Cl. ..... 297/344.18; 297/16.1; 297/16.2; 297/51; 297/53; 297/54; 297/188.08; 297/378.1; 297/440.1; 297/440.24; 297/452.21; 297/452.22; 297/452.23; 4/578.1; 4/590

(58) Field of Classification Search ..... 297/344.18, 297/16.1, 16.2, 51, 53, 54, 188.08, 378.1, 297/440.1, 440.24, 452.21, 452.22, 452.23; 4/578.1, 590

See application file for complete search history.

(56) References Cited

U.S. PATENT DOCUMENTS

| | | | | | |
|---|---|---|---|---|---|
| 1,922,418 | A | * | 8/1933 | Conant | 297/344.18 X |
| 2,849,054 | A | * | 8/1958 | Shepherdson | 297/17 |
| 2,966,204 | A | * | 12/1960 | Caravias | 297/17 |
| 2,978,012 | A | * | 4/1961 | Norseen | 297/183.1 X |
| 3,765,718 | A | * | 10/1973 | Chen | 297/17 |
| 4,253,203 | A | * | 3/1981 | Thomas | 4/559 |
| 4,359,791 | A | * | 11/1982 | Thomas | 4/546 |
| 4,472,844 | A | * | 9/1984 | Mace | 4/579 |
| 4,475,256 | A | * | 10/1984 | Hatala | 4/562.1 |
| 4,520,515 | A | * | 6/1985 | Hatala | 4/579 |
| 5,048,132 | A | | 9/1991 | Rizzo | |
| D347,526 | S | * | 6/1994 | Hamilton | D6/335 |
| 5,335,377 | A | * | 8/1994 | Masyada et al. | 4/578.1 |
| 5,388,286 | A | | 2/1995 | Davenport | |
| 5,806,110 | A | | 9/1998 | Kunz et al. | |
| 5,822,809 | A | * | 10/1998 | Gallo | 4/578.1 |
| 5,845,962 | A | | 12/1998 | Lin | |
| 5,848,822 | A | * | 12/1998 | Wu | 297/344.18 |
| 5,887,297 | A | * | 3/1999 | Sutor | 4/578.1 |
| D411,054 | S | * | 6/1999 | Williams | D6/335 |
| 5,937,454 | A | * | 8/1999 | Drew | 4/565.1 |
| 6,015,185 | A | * | 1/2000 | Buono | 297/16.1 |
| 6,039,403 | A | * | 3/2000 | Hargroder | 297/440.24 |
| 6,056,353 | A | * | 5/2000 | Meara | 297/344.18 X |

(Continued)

FOREIGN PATENT DOCUMENTS

WO PCT/US1998/16288 2/1999

OTHER PUBLICATIONS

European Patent Office Search Report dated Nov. 12, 2007, for Applicant's co-pending European Patent Application No. 07016359.7 - 2313.

*Primary Examiner*—Rodney B White
(74) *Attorney, Agent, or Firm*—Ogilvy Renault LLP

(57) ABSTRACT

A foldable bath seat includes at least a seat member and two leg assemblies each having two legs connected with a crossbar. Each of the crossbars is pivotally mounted to a bottom seat portion to allow the legs to pivot between a folded position and a downwardly extended position.

18 Claims, 9 Drawing Sheets

U.S. PATENT DOCUMENTS 6,105,183 A * 8/2000 Bly ..... 4/579
6,122,776 A * 9/2000 Cheng ..... 4/578.1
6,182,304 B1 * 2/2001 Freeberg ..... 4/560.1
D439,429 S 3/2001 Higgs et al.
6,195,813 B1 3/2001 Orcini
D479,068 S * 9/2003 Gilbert et al. ..... D6/502
6,676,208 B2 * 1/2004 Lu ..... 297/16.1 X
6,698,830 B1 * 3/2004 Gaines ..... 297/188.11
6,702,384 B1 * 3/2004 Brown ..... 297/344.18
6,921,135 B2 * 7/2005 Ellis et al. ..... 297/344.18
6,957,865 B1 * 10/2005 Adams et al. ..... 297/344.12
6,969,112 B1 * 11/2005 Sherrill ..... 297/344.18 X
6,974,191 B2 * 12/2005 Serhan ..... 297/440.24
D519,291 S * 4/2006 Higgs et al. ..... D6/367
D526,517 S 8/2006 Adams et al.
7,121,620 B1 10/2006 Fang
2003/0102700 A1 6/2003 Lin
2004/0051365 A1 * 3/2004 Darst et al. ..... 297/440.1

* cited by examiner

FOLDABLE BATH SEAT

FIELD OF THE INVENTION

The present invention relates to a seat, and more particularly to a foldable bath seat which can be folded into a compact state for storage or carrying.

BACKGROUND OF THE INVENTION

Bath seats are generally used for assisting people in taking a bath or shower. However, the conventional bath seats were developed with specific applications in mind and it is usually necessary to select a different bath seat design for each application where the bath seat is needed. For example, bath seats may be used in the nursing field to allow a caregiver to put a patient who is unable to move by himself/herself on a bath seat and give the patient a bath. Bath seats may also be used to permit safely sitting in a bath tub while showering or bathing themselves by those with stability/balance challenges, those at risk of falling such as the elderly, post-surgery patients, people with injuries to the lower body region or pregnant women, etc. Those who require the use of a bath seat, usually have to try to find one that addresses their specific disability.

A conventional bath seat is generally large and usually has to be stored somewhere other than in the bathroom. Even those with conventional adjustable legs and/or foldable or collapsible configurations, still have a relatively large dimension, particularly the height dimension, even when in a retracted or folded condition for storage.

Therefore, there is a need for a generally comfortable and stable bath seat for use in many application conditions, which allows for a relatively compact dimension when in a folded condition for storage and carrying.

SUMMARY OF THE INVENTION

In accordance with one aspect of the present invention, there is a foldable bath seat which comprises a seat member integrally having a top seat portion and a bottom seat portion, extending longitudinally between a front and a rear and extending transversely between opposed sides of the seat member; and first and second leg assemblies pivotally mounted to the seat member at the respective front and rear of the seat member, each leg assembly including two legs connected by a transverse crossbar to form a U-shaped component, the transverse crossbar being pivotally mounted to the bottom seat portion of the seat member in order to allow the legs to pivot about a transverse pivoting axis extending through the seat member, between a folded position and an downwardly extended position In accordance with another aspect of the present invention, there is a foldable bath seat which comprises a seat member integrally having a top seat portion and a bottom seat portion, extending longitudinally between a front and a rear and extending transversely between opposed sides of the seat member; first and second leg assemblies pivotally mounted to the seat member at the respective front and rear of the seat member, each leg assembly including two legs pivotable about a transverse pivoting axis between a folded position and an downwardly extended position; and a backrest having a front portion and a rear portion, the backrest being pivotally mounted to the rear of the seat member to pivot between an upwardly extended position and a folded position.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
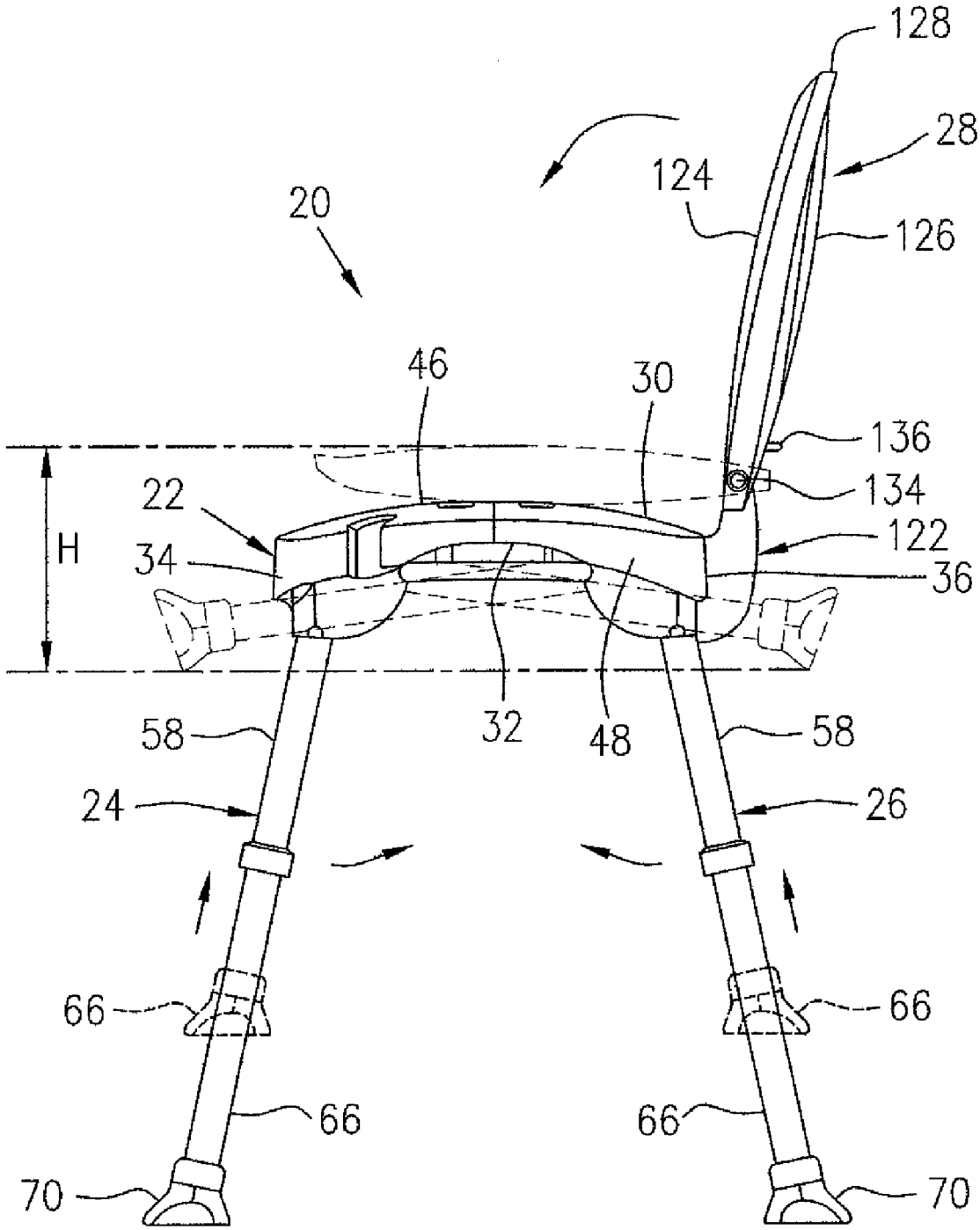
FIG. 1 is a side elevational view of a foldable bath seat according to one embodiment of the present invention, showing the foldable bath seat in both a fully extended position for use and a fully folded position for storage and carrying.
Figure 2:
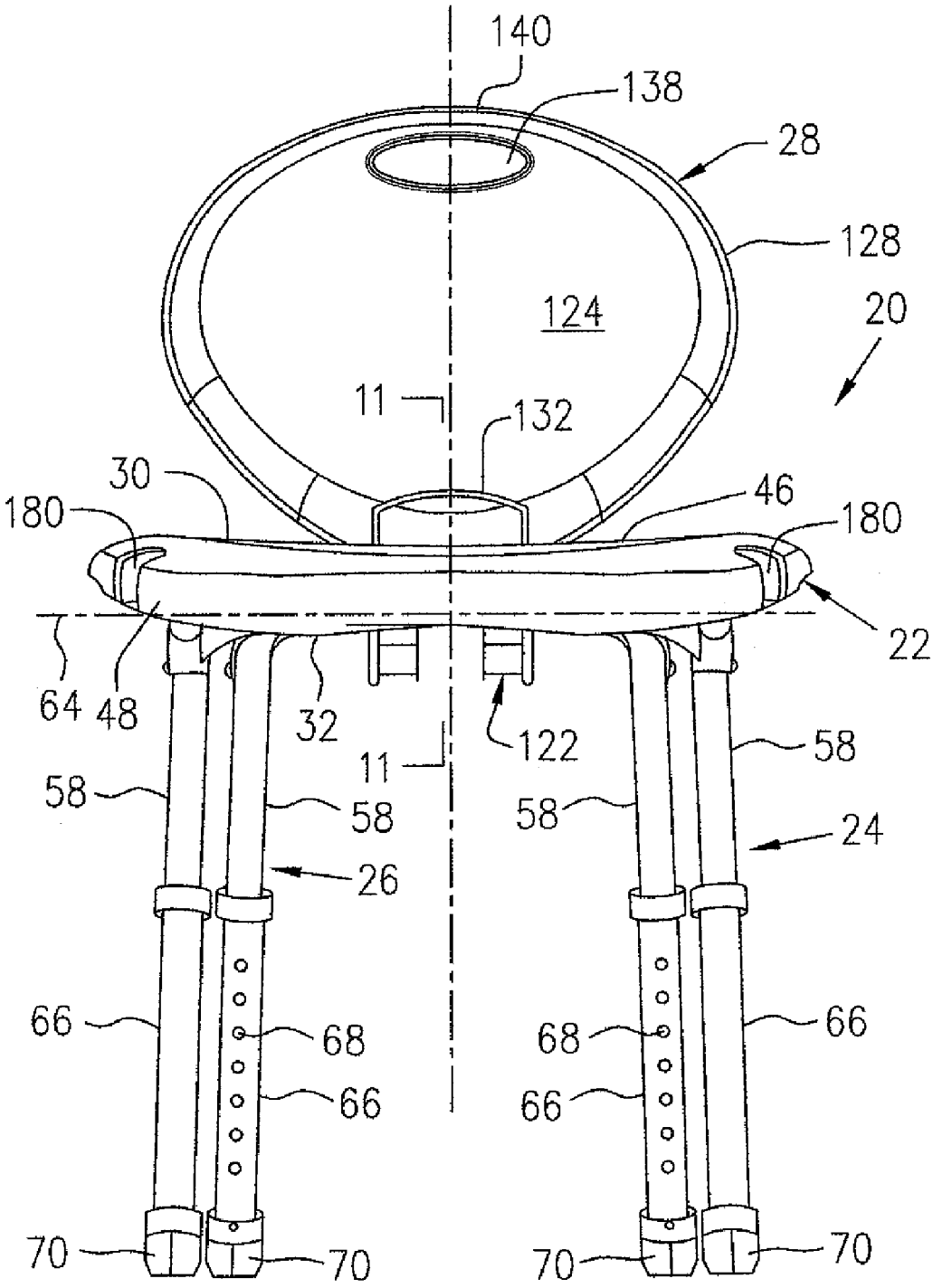
FIG. 2 is a front elevational view of the foldable bath seat of FIG. 1, showing a top seat portion of the seat member having a central area configured in a concave profile.
Figure 3:
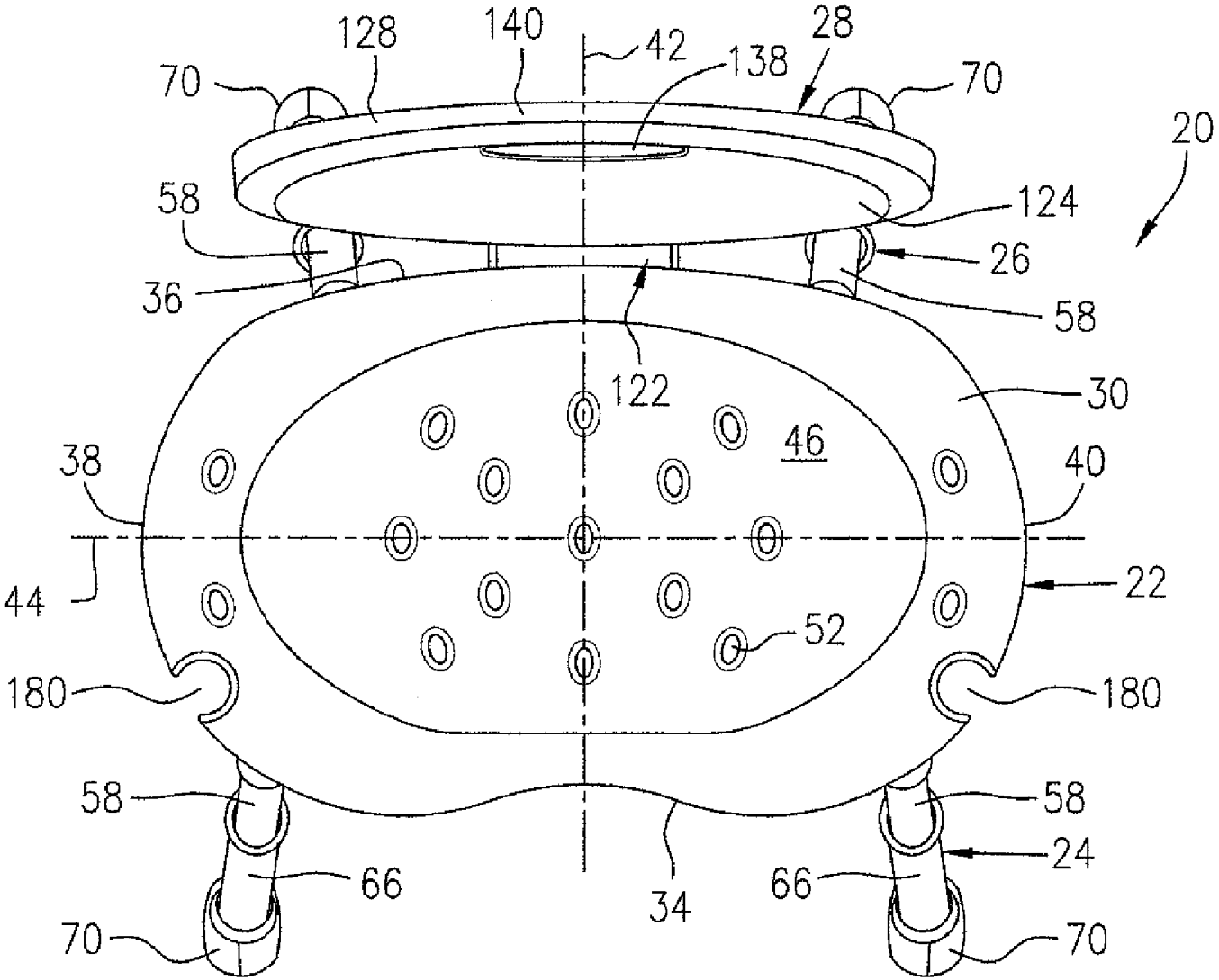
FIG. 3 is a top plane view of the foldable bath seat of FIG. 1, showing the top seat portion of the seat member.

Referring to FIGS. 1-4, a foldable bath seat according to one embodiment of the present invention, generally indicated by numeral 20, includes a seat member 22, a front leg assembly 24 and a rear leg assembly 26. Optionally, a backrest 28 is also provided.

Further reference is made to FIGS. 1-5. The seat member 22 integrally has a top seat portion 30 and a bottom seat portion 32, both extending longitudinally between a front 34 and a rear 36 and extending transversely between opposed sides 38, 40 of the seat member 22. A longitudinal axis of the foldable bath seat 20 is indicated by numeral 42 and a transverse axis of the foldable bath seat 20 is indicated by numeral 44 (see FIGS. 3-4).

The seat member 22 is optionally configured with at least a central area 46 of the top seat portion 30, having a convex profile in a longitudinal side view (see FIG. 1) and having a concave profile in a front elevational view (see FIG. 2), in order to provide a comfortable seating for a user. The seat member 22 generally has a curved periphery along which a skirt 48 extending downwardly from the top seat portion 30, may be provided to increase the rigidity and strength of the seat member 22, as well as the aesthetic presentation. A plurality of ribs 50 (see FIGS. 4 and 5) may also be provided within the skirt 48, integrated with and formed as a part of the bottom seat portion 32. A plurality of draining holes 52 are optionally defined in the seat member 22, extending through the top seat portion 30 and the bottom seat portion 32. The edges of the draining holes 52 at the top seat portion 30 may be beveled and the draining holes 52 may also be reinforced by circular ribs 54 therearound which are integrated to the bottom seat portion 32 (see FIG. 4).

Figure 4:
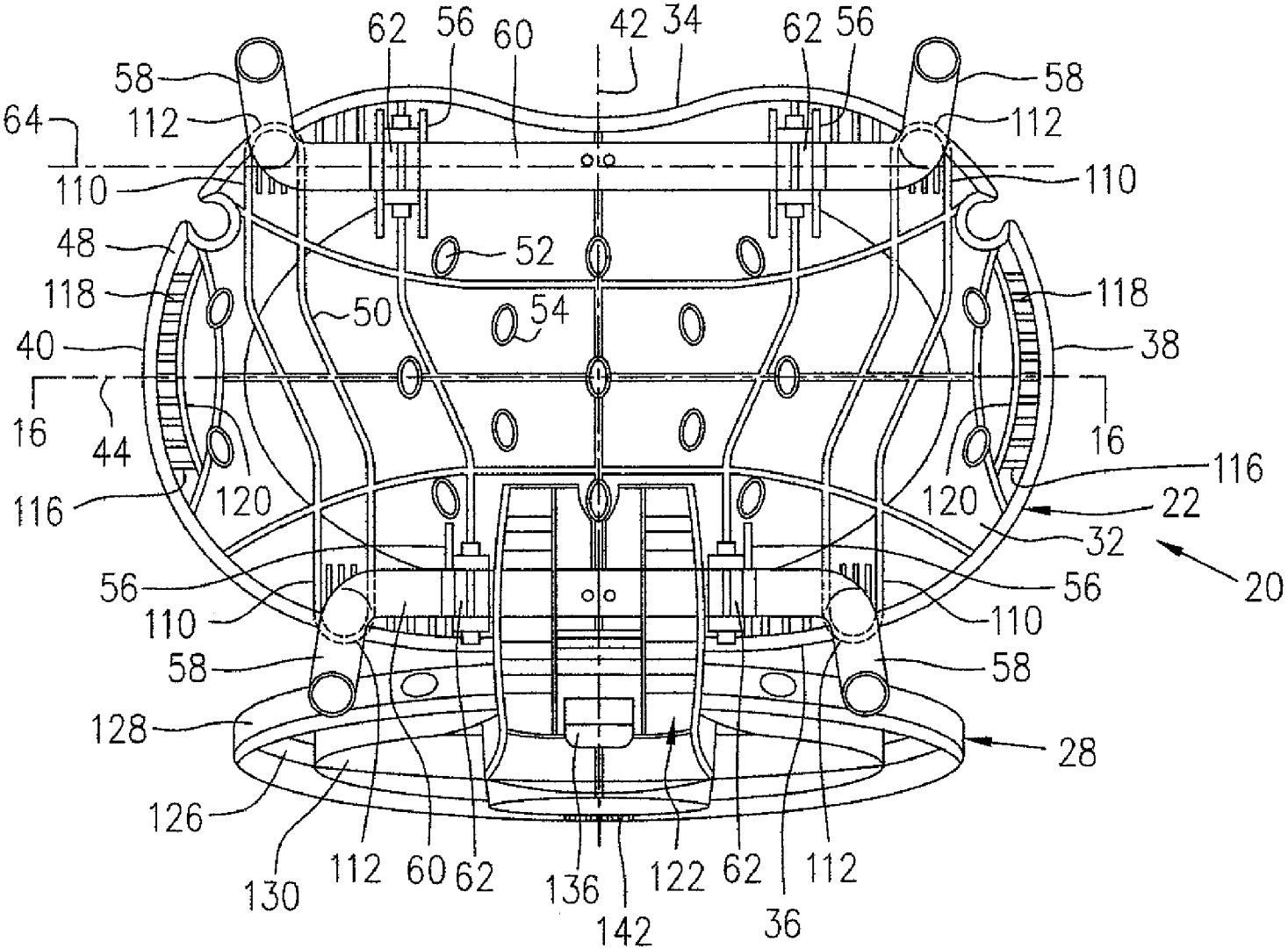
FIG. 4 is a bottom plane view of the foldable bath seat of FIG. 1, with leg extensions removed, showing the pivotal attachment of the leg assemblies to the seat member.
Figure 5:
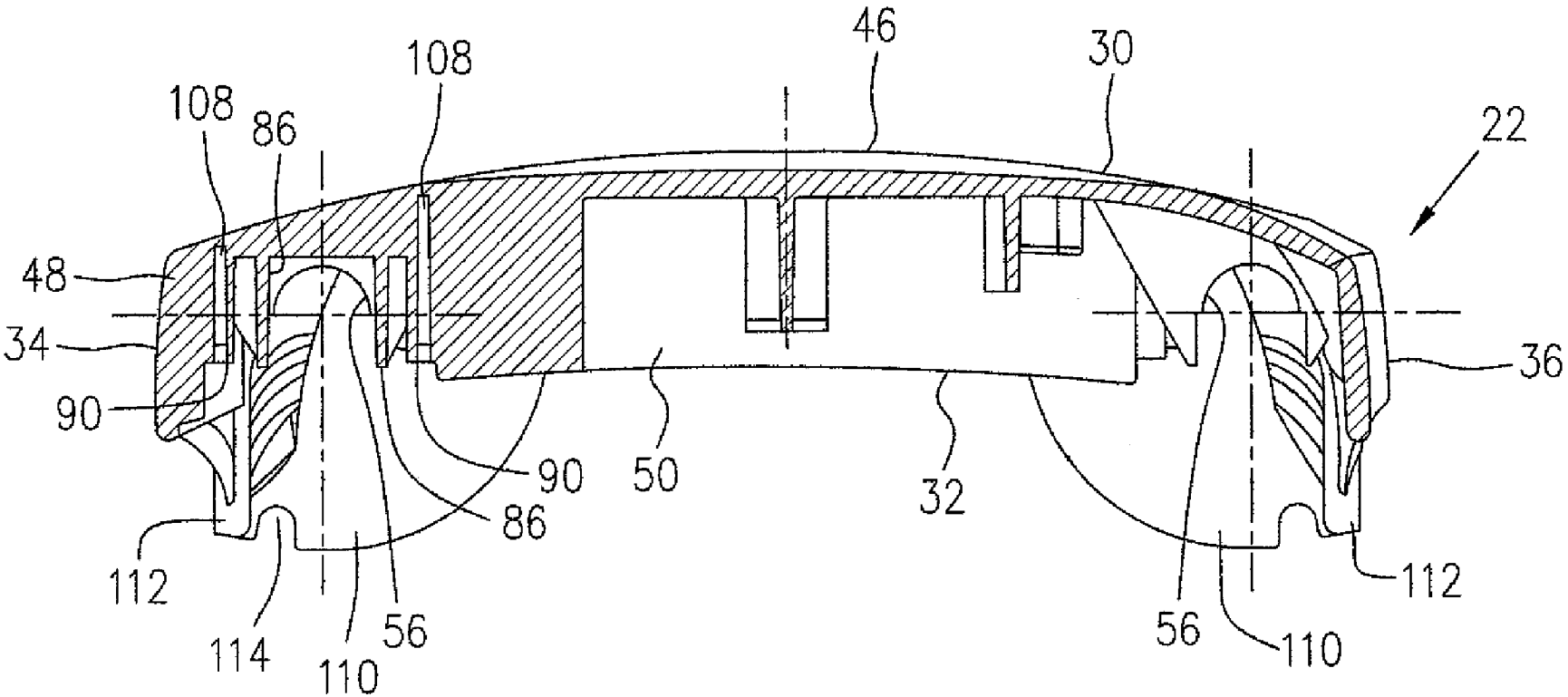
FIG. 5 is a longitudinal cross-sectional view of the seat member of the foldable bath seat of FIG. 1, showing bearing seats integrated with the bottom seat portion, for receiving U-shaped components of the respective leg assemblies.
Figure 7:
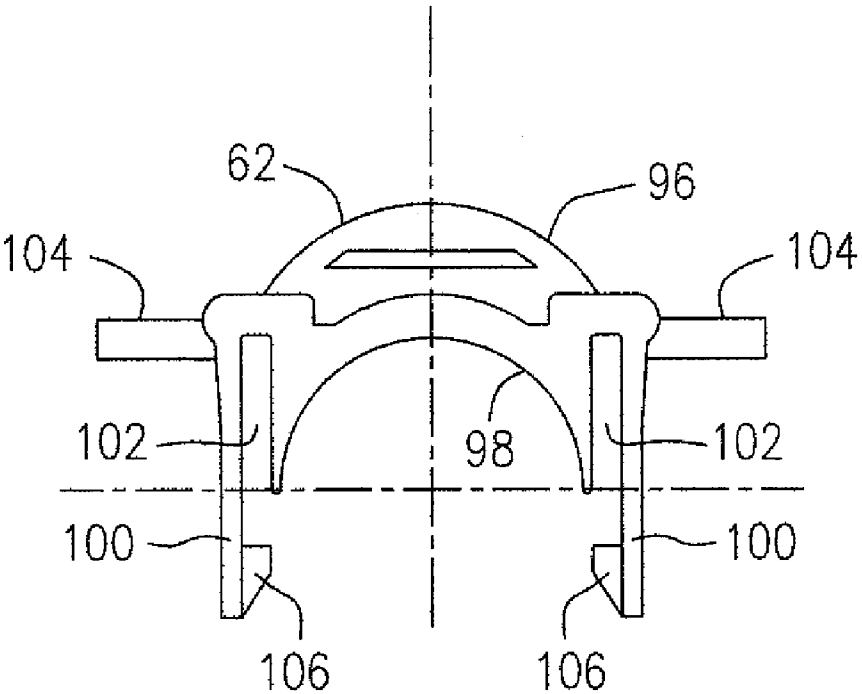
FIG. 7 is a side elevational view of a bearing bracket for use in combination with the bearing seats shown in FIGS. 5 and 6 to pivotally connect the leg assemblies to the seat member.

Further provided are a plurality of bearing seats which may be integrated with the bottom seat portion 32 of the seat member 22, for pivotally receiving the respective front and rear leg assemblies 24, 26. In this embodiment, four bearing seats 56 are provided, two located at the front 34 and two located at the rear 36 of the seat member 22, as shown in FIGS. 4 and 5. The bearing seats 56 and other features of the seat member 22 will be further described below.

The front leg assembly 24 and the rear leg assembly 26 are substantially in a similar configuration except that the rear leg assembly 26 has a relatively smaller dimension in the transverse direction of the foldable bath seat 20. Therefore, as an example of those leg assemblies and for simplicity of description, only the front leg assembly 24 will be described in detail. It should be noted that the same reference numerals are used to indicate similar components in both front and rear assemblies 24, 26.

The front leg assembly 24 includes two legs 58 connected by a transverse crossbar 60 (see FIG. 4), to form a U-shaped leg component (not indicated). The legs 58 and the crossbar 60 may be made of an integral tube. The transverse crossbar 60 is pivotally received in the respective two bearing seats 56 located at the front 34 of the seat member 22 and is secured in position by a pair of bearing brackets 62 which are removably attached to the respective bearing seats 56, to thereby form respective bearing supports to the U-shaped leg component. Therefore, the front leg assembly 24 is enabled to pivot about a transverse pivoting axis 64 (see FIGS. 2 and 4) extending through the bottom seat portion 32 of the seat member 22, between a folded position (as illustrated by the leg assemblies shown in broken lines in FIG. 1) and a downwardly extended position. The legs 58 of each of the leg assemblies 24, 26 extend slightly outwardly from the connected transverse crossbar 60, such that each of the U-shaped leg components is slightly wider between opposed free ends than the length of the crossbar 60 (see FIG. 4), in order to provide a more stable support to the foldable bath seat 20 (see FIG. 2). In the fully downwardly extended position, each of the leg assemblies 24, 26 are slightly pivoted over a vertical position such that the respective front and rear legs 58 with the extensions 66 are in an inclined orientation to provide an elongated support area to the foldable bath seat 20 (see FIG. 1).

Each of the legs 58 may be provided with a slidable leg extension 66. In this embodiment, the slidable leg extension 66 is optionally made of a section of a tube in a telescoping connection with the leg 58. The leg extension 66 may have a plurality of positioning holes 68 (see FIG. 2) for selectively receiving a spring-biased pin/button (not shown) mounted to the leg 58 such that the leg extension 66 can be conveniently locked in a selected position with respect to the leg 58, for height adjustment of the foldable bath seat 20. Each of the leg extensions 60 may include a leg end tip 70 to prevent slippage of the foldable bath seat 20 when supported on a wet bottom surface of a bath tub, shower, or the like (not shown). The leg end tips shown in broken lines in FIG. 1, illustrate an adjusted position of the leg extension 66 such that the front and rear leg assemblies 24, 26 are in a shortest length.

Figure 15:
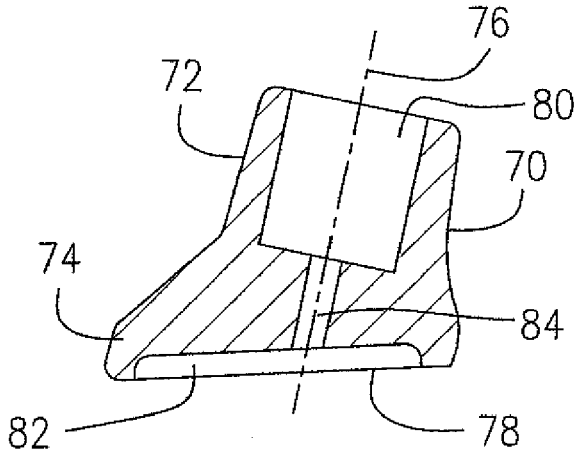
FIG. 15 is a cross-sectional view of a leg tip for attachment to a bottom end of the leg extension.

As illustrated in FIG. 15, the leg end tip 70 is optionally made of a soft material such as rubber or other elastomer materials. The leg end tip 70 has a substantially cylindrical upper portion 72 and an enlarged lower portion 74 shaped like a shoe. The cylindrical upper portion 72 defines a central axis 76 slightly off from a position perpendicular to a bottom end 78 of the shoe-shaped lower portion 74, in order to correspond with the inclined orientation of the leg assemblies 24, 26 when in the fully extended position (see FIG. 1) The leg end tip 70 further defines a cylindrical hole 80 in the cylindrical upper portion 72 for receiving a bottom end of the leg extension 66. A recess 82 is defined at the bottom end 78 of the shoe-shaped lower portion 74. A water draining hole 84 extends through the leg end tip 70 from the hole 80 to the recess 82 such that water collected within the front and rear leg assemblies 24, 26 can be discharged.

Figure 6:
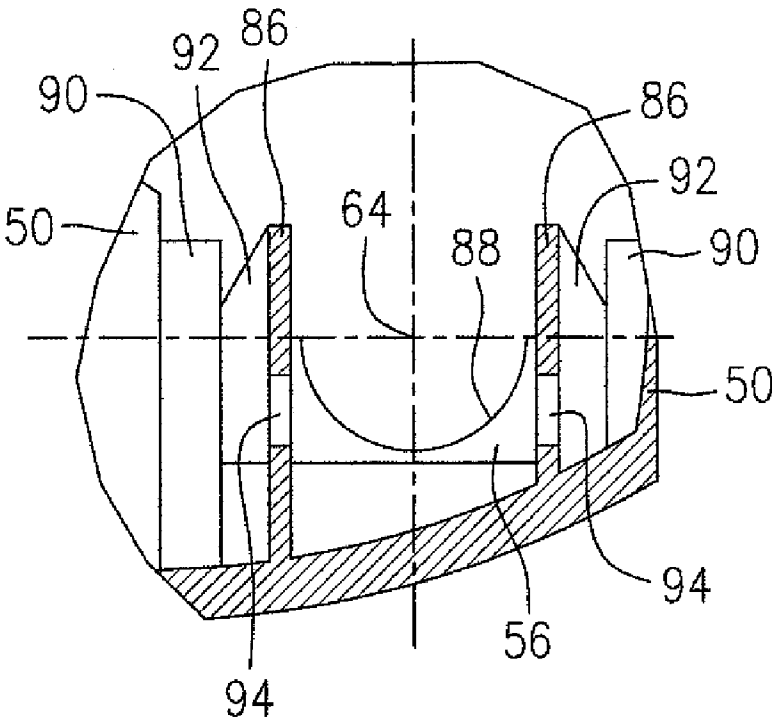
FIG. 6 is a partial longitudinally cross-sectional view of the seat member of FIG. 5, showing the bearing seat in an enlarged scale for receiving a U-shaped component of a rear leg assembly.
Figure 10:
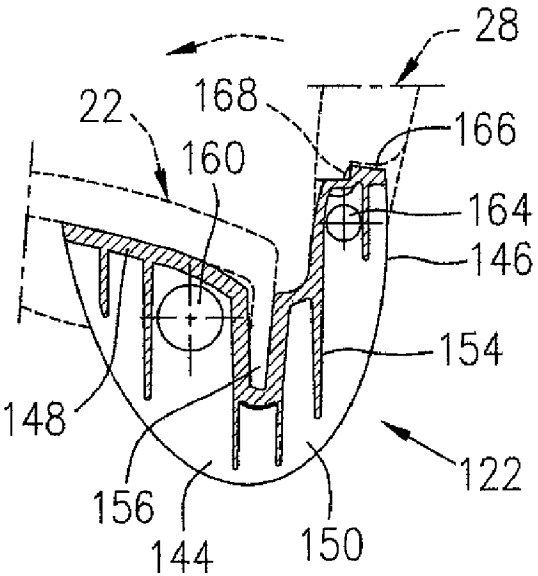
FIG. 10 is a cross-sectional view of the backrest support of FIG. 8, taken along line 10-10, showing the reinforcing ribs thereof.
Figure 9:
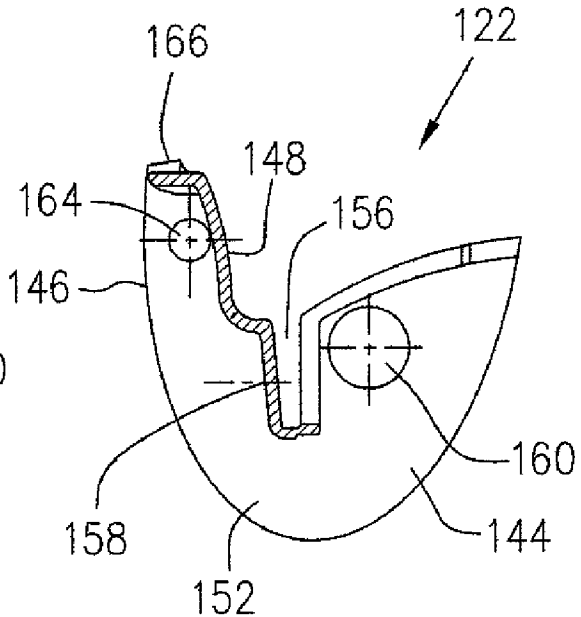
FIG. 9 is a cross-sectional view of the backrest support of FIG. 8, taken along line 9-9.
Figure 8:
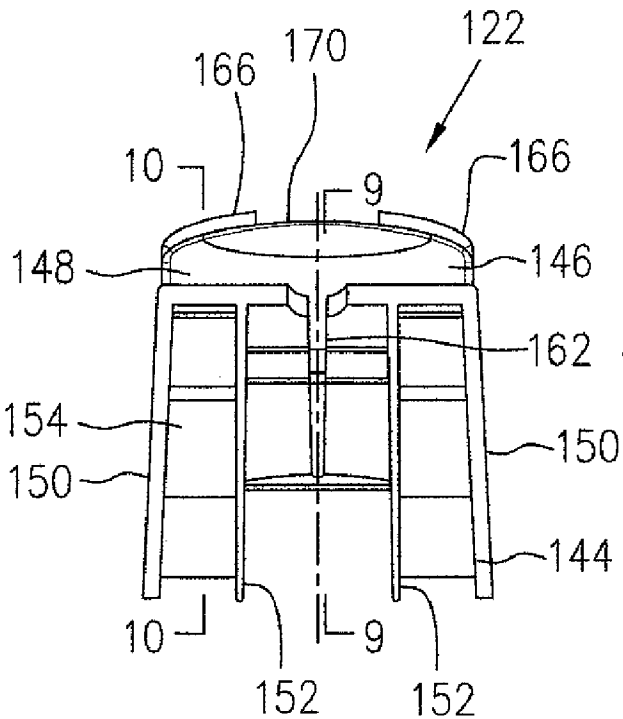
FIG. 8 is a front elevational view of a backrest support used for pivotally connecting the backrest to the seat member of the foldable bath seat of FIG. 1.

With reference to FIGS. 4-7, the bearing seats 56 which are substantially similar, are illustrated in different views. In FIG. 5, the bearing seat 56 near the front 34 of the seat member 22 is shown in a cross-sectional view cutting through a central plane thereof about which the bearing seat 56 is symmetric. The bearing seat 56 near the rear 36 of the seat member 22 is located closer to the longitudinal axis 42 (see FIG. 4) than the bearing seat 56 near the front 34, and thus a side other than a cross-section of the bearing seat 56 near the rear 36 is viewed in the cross-sectional view of the seat member 22 in FIG. 5 Bearing seat 56 in FIG. 6 is shown in a upside-down cross-sectional view which is cut through a plane slightly off a central symmetrical plane of the bearing seat 56, presenting differently from the central cross-sectional view of the bearing seat 56 near the front 34 of the seat member 22 in FIG. 5. Each of the bearing seats 56 includes two parallel side walls 86 having a transverse orientation and extending downwardly from a body of the seat member 22 and defining a semicircular bearing surface 88 therebetween. The two side walls 86 are spaced apart from respective screw bosses 90 which in turn are integrated with a reinforcing rib 50. The space between each side wall 86 and each screw boss 90 is indicated by numeral 92. Openings 94 are defined in the respective side walls 86. It should be noted that the bearing seat 56 is configured and positioned such that the center of the semicircular bearing surface 88 which forms the pivoting axis 64 (see FIG. 2), extends through the bearing seat member 22, thereby resulting in a relatively compact configuration of the foldable bath seat 20 when in a fully folded condition. The bearing seat 56 is optionally integrated with the bottom seat portion 32 as illustrated in this embodiment, When the crossbar 60 is placed within the bearing seat 56 as shown in FIG. 4, the bearing bracket 62 is removably attached to each bearing seat 56 to thereby form a complete bearing support in order to pivotally connect the crossbar 60 to the seat member 22 as illustrated in FIG. 4. The bearing bracket 62 has a body 96 defining a complimentary semicircular bearing surface 98, and two parallel insertion plates 100 extending from the body 96 of the bearing bracket 62. A groove 102 is provided between each insertion plate 100 and the body 96 of the bearing bracket 62. Two side extensions 104 extend laterally outside of the body 96 of the bearing bracket 62. A lock tongue 106 projects inwardly from a free end of each insertion plate 100. When the bearing bracket 62 is attached to a bearing seat 56, the two insertion plates 100 are inserted into the respective spaces 92 outside of the side walls 86 of the bearing seat 56 while the side walls 86 are received in the respective grooves 102 of the bearing bracket 62. When the bearing bracket 62 is placed in a position such that the semicircular bearing surface 88 of the bearing seat 56 and the semicircular bearing surface 98 of the bearing bracket 62 in combination form a complete bearing track, the lock tongue 106 of each insertion plate 100 engages the opening 94 in the side walls 86 of the bearing seat 56. Therefore, the bearing bracket 62 is removably secured in position. Because of the resiliency and the flexibility of the insertion plate 100 and the beveled front end of the lock tongue 106, it is relatively easy to elastically deform the insertion plates 100 when plugged into the bearing bracket 62. The bearing bracket 96 can also be removed with a little effort. Mounting screws (not shown) may also be provided to secure the bearing bracket 62 to the bearing seat 56, extending through mounting holes (not shown) in the side extension 104 of the mounting bracket 62 to be engaged within threaded holes 108 in the screw bosses 90 of the seat member 22 (see FIG. 5).

In FIGS. 4 and 5, a side guide plate 110 is provided to restrain the transverse position of the leg 58 in the pivoting motion. The guide plates 110 may be optionally integrated with the reinforcing ribs 50 as illustrated in FIG. 4 according to this embodiment. A stopper 112 is further provided at each of the side guide plates 110 to position each of the legs 58 in the fully extended position as shown in FIG. 1 and to prevent the leg 58 from over-pivoting. The stopper 112 may be optionally integrated with the skirt 48 of the seat member 22 and may extend from the skirt 48 further downwardly to a level of the side guide plate 110. A recess 114 (see FIG. 5) may be optionally defined in a location of the side guide plate 110 adjacent to the stopper 112, for selectively receiving a locking mechanism, for example, a spring-biased pin/button (not shown), mounted on each leg 58 such that the spring-biased pin/button is pressed by the side guide plate 110 into the leg 58 unless the leg is pivoted to the fully extended position as shown in FIG. 1, in which position the spring-biased pin/button projects and is received by the recess 114.

Figure 16:
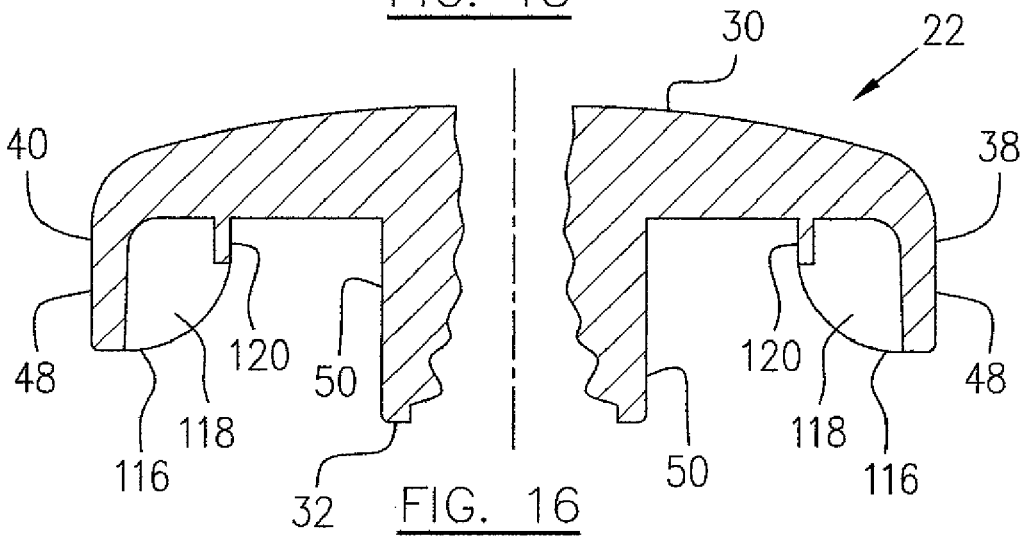
FIG. 16 is a partial transversely cross-sectional view of the foldable bath seat of FIG. 4, taken along line 16-16, showing a pair of hand grips concealed beneath the top seat portion and incorporated with the bottom seat portion of the seat member.

With reference to FIGS. 4 and 16, two hand grips 116 are provided at opposed sides 38, 40 of the seat member 22 to allow a user to grip same for safely entering and exiting a bath tub. The hand grips 116 are optionally located beneath the top seat portion 30 and are integrated with the bottom seat portion 32, to thereby form a "concealed" hand grip in this embodiment. The concealed hand grips will not cause any inconvenience to and/or interference with the user's entering and exiting actions. A plurality of parallel ribs 118 having a smoothly curved profile are provided between a section of the skirt 48 and a supporting rim 120 which has a curvature similar to the section of the skirt 48 (see FIG. 4). Therefore, the combination of the skirt 48, the supporting rim 120 and the parallel extending ribs 118, forms the hand grip 116 to allow a very comfortable and secure grip by the user.

In FIGS. 1-4, the backrest 28 may be pivotally mounted to the rear 36 of the seat member 22, with an optional backrest support 122 between an upwardly extended position and a fully folded position (as shown in broken lines in FIG. 1) for storage and carrying. The backrest 28 includes a front portion 124 and a rear portion 126 defined, for example, within a substantially balloon-profiled periphery. Similarly to the seat member 22, the backrest 28 includes a skirt 128 along the balloon-profiled periphery, extending rearwardly from the front portion 124 to enhance the rigidity and strength of the backrest 28. Optionally, a plurality of ribs 130 are provided within the peripheral skirt 128, and are integrated with the rear portion 126 (see FIG. 4). The ribs 130 form part of the rear portion 126 of the backrest 28. A U-shaped recess 132 (see FIG. 2) is defined in the backrest 28, extending upwardly and inwardly from a bottom portion of the balloon-profiled periphery, for receiving the backrest support 122. A pivoting pin 134 (see FIG. 1) which is received in a pair of aligned holes (not indicated) defined in the rear portion 126 of the backrest 28, extends across the U-shaped recess 132 to provide a pivotal connection between the backrest 28 and the backrest support 122 which is in turn, removably mounted to the rear 36 of the seat member 22. An elastically deformable lock mechanism 136 is provided at a top of the outwardly and inwardly extending U-shaped recess 132. An opening 138 may be optionally defined through the backrest 28 at a top peripheral area thereof, thereby forming a hand grip 140 (see FIGS. 2 and 3) between the opening 138 and a top portion of the skirt 128, for convenience of folding and carrying the foldable bath seat 20. Similar to the ribs 118 of the hand grips 116 shown in FIG. 16, a plurality of ribs 142 (see FIG. 4) may also be provided in the rear portion 126 of the back rest 28 between the top section of the skirt 128 and the opening 138.

Referring to FIGS. 1-4 and 8-11, the backrest support 122 generally has a hook-like side profile including a base portion 144 attached to the bottom seat portion 32 of the seat member 22, and a rear portion 146 integrated with the base portion 144 and extending upwardly at the rear 36 of the seat member 22. The backrest support 122 including the integral base and rear portions 144, 146, may be made in a hollow configuration having a profiled top body 148 and outer and inner side plates 150, 152 with reinforcing ribs 154 extending between the respective outer and inner side plates 150, 152. In the base portion 144, a transverse groove 156 is defined by the profiled top body 148, for receiving a rear section of the skirt of the seat member 22 (shown in broken lines in FIG. 10) while the profiled top body 148 at the base portion 144 may abut an undersurface of the bottom seat portion of the seat member 22. Mounting screws (not shown) may be provided to fasten the backrest support 122 to the seat member 22. Numeral 158 indicates a selected location, for example, to mount the screws. Aligned holes 160 may be defined in the respective outer and inner side plates 150, 152 for receiving the transverse crossbar 60 of the rear leg assembly extended therethrough. In order to assemble the rear leg assembly to the seat member 22, the crossbar 60 is separated into left-hand and right-hand halves which are inserted oppositely inwardly from the respective outer side plates 150 into the holes 160 and are then connected together to form the U-shaped leg component. When the U-shaped leg component including the transverse crossbar 60 with the rear legs 58, is so attached to the backrest support 122, the combination is then attached to the seat member 22 with the respective backrest support 122 and the crossbar 60 in position. Alternatively, if the holes 160 in the respective outer and inner side plates 150, 152 of the backrest support 122 are replaced by open recesses, the U-shaped component of the rear leg assembly need not be separated into two pieces and the one-piece U-shaped leg component may be placed in position after the backrest support 122 is attached to the seat member 22. A center groove 162 may be provided in the profiled top. body 148 of the base portion 144 to allow a reinforcing rib 50 of the seat member 22 to extend therethrough.

Holes 164 are defined in the respective outer and inner side plates 150, 152 at the rear portion 146 of the backrest support 122. The pivoting pin 134 is pivotally extended therethrough when the backrest 28 is attached to the backrest support 122 and the top of the rear portion 146 of the backrest support 122 is received within the U-shaped recess 132 of the backrest 28. Two stop shoulders 166 are provided at opposite sides of the top of the rear portion 146, to abut a ridge 168 of the backrest 28 defined in the U-shaped recess 132 (shown in broken lines in FIG. 10), in order to prevent the backrest 28 from over-pivoting when the backrest 28 reaches the upwardly extended position.

A space 170 (see FIG. 8) between the two shoulders 166 allows the plastically deformable lock mechanism 136 to pass therethrough when the backrest 28 is pivoted towards the upwardly extended position. The elastically deformable lock mechanism 136 has a projecting member 172 (see FIG. 11) which abuts a rear end 174 of the top of the profiled top body 148 of the rear portion 146 of the backrest support 122, in order to lock the backrest 28 in the upwardly extended position. The resiliency of the elastically deformable lock mechanism 136 allows the elastically deformable lock mechanism 136 to disengage the projecting member 172 from the rear end 174 of the profiled top body 148 when being pulled upwardly to allow the backrest 28 to be pivoted towards the fully folded position.

Figure 13:
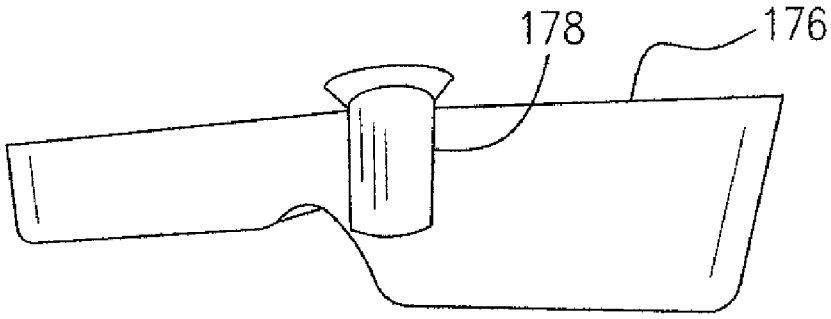
FIG. 13 is a side elevational view of the soap dish of FIG. 12.
Figure 12:
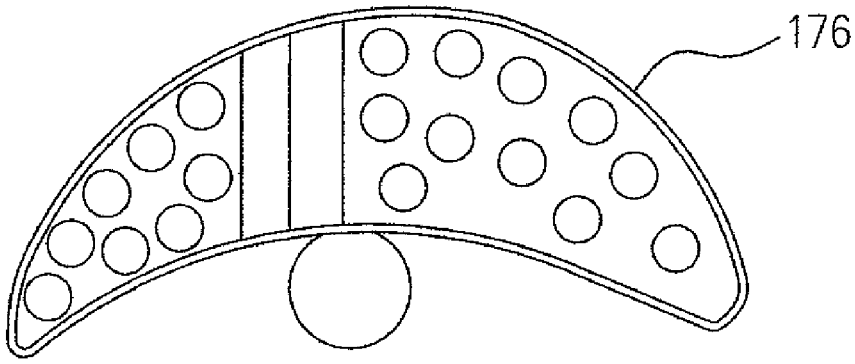
FIG. 12 is a top plane view of a soap dish for selective attachment to the foldable bath seat of FIG. 1.
Figure 11:
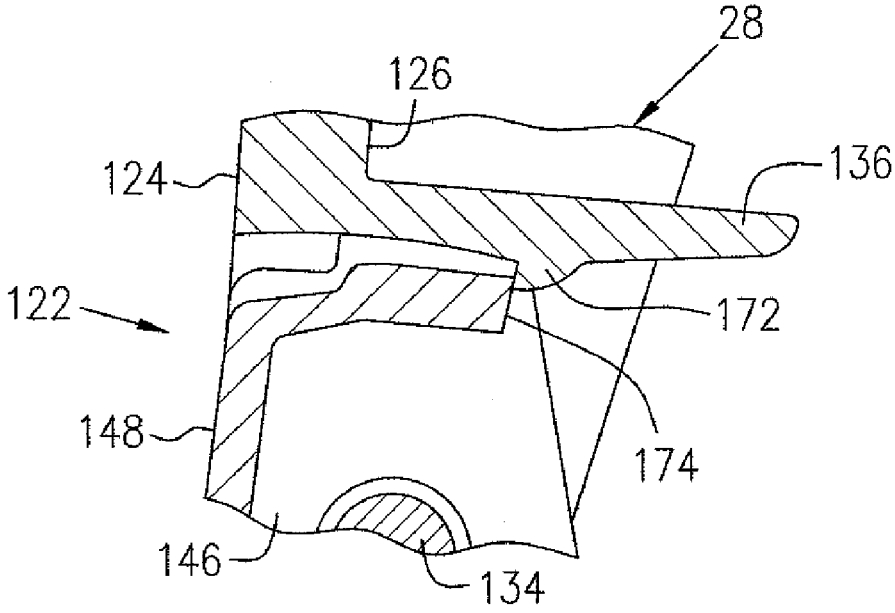
FIG. 11 is a partial longitudinally cross-sectional view of the foldable bath seat of FIG. 2, taken along line 11-11, showing the locking mechanism for locking the backrest in the upwardly extended position.

Referring to FIGS. 2-3 and 12-13, a pair of soap dishes 176 may be provided for selective attachment to the seat member 22. The soap dishes 176 illustrated in FIGS. 12, 13 are an example only and may be configured in different shapes or styles. The soap dish 176 may optionally have a substantially cylindrical or slightly tapered conical attaching member 178 with an enlarged head to be removably inserted into and held in the respective recesses 180 defined in the respective sides 38, 40 of the seat member 22. The soap dish 176 may also include a plurality of water draining holes (not indicated) in the bottom thereof.

Figure 14:
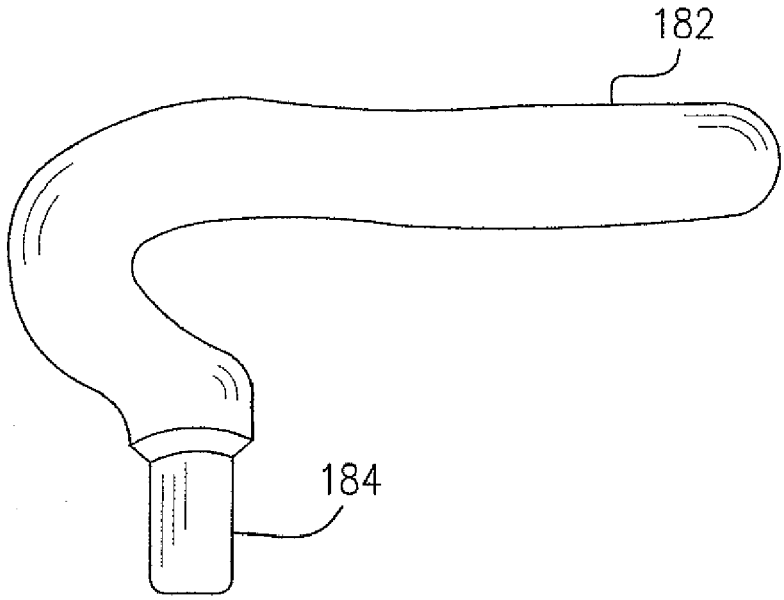
FIG. 14 is a side elevational view of an arm rest for selective attachment to the foldable bath seat of FIG. 1.

A pair of armrests 182, for example, as illustrated in FIG. 14, may be optionally provided. Each of the armrests 182 has an attaching member 184 similar to the attaching member 178 of the soap dish in FIG. 13, such that the armrest 182 may be received in the respective recesses 180 of the seat member 22, alternative to the soap dish 178. Furthermore, the recesses 180 of the seat member 22 may receive other accessories such as a shower nozzle head, etc.

The seat member 22, backrest 28 and backrest support 122 may be made of any suitable materials, such as plastics, etc. When plastic material is used, these components may be made in a molding process. The legs 58 and leg extensions 66 may be made of any suitable materials such as metal materials, etc. When a metal material is selected, stainless steel tubes, aluminium tubes or other tubular materials may be chosen.

The foldable bath seat according to the described embodiment of the present invention, advantageously provides comfortable and secure seating for a user when bathing or showering in a bathtub and convenience and safety when entering and exiting the bathtub. The foldable bath seat according to the described embodiment of the invention also advantageously allows a very compact fully folded condition in which a height dimension H, as indicated in FIG. 1, can be equal to or even smaller than 20 cm. The foldable bath seat according to the described embodiment of the present invention can be fully assembled and shipped in the folded condition. Therefore, it is convenient for user to use the foldable bath seat without any assembling procedure after unpacking this product.

The above description is meant to be exemplary only and one skilled in the art will recognize that changes may be made to the embodiment described without departing from the scope of the invention disclosed. Modifications which fall within the scope of the present invention will be apparent to those skilled in the art in light of a review of this disclosure, and such modifications are intended to fall within the appended claims.

I claim:

1. A foldable bath seat comprising:

a seat member integrally having a top seat portion and a bottom seat portion, extending longitudinally between a front and a rear and extending transversely between opposed sides of the seat member;

first and second leg assemblies pivotally mounted to the seat member at the respective front and rear of the seat member, each leg assembly including two legs connected by a transverse crossbar to form a U-shaped component, the transverse crossbar being pivotally mounted to the bottom seat portion of the seat member in order to allow the legs to pivot about a transverse pivoting axis extending through the seat member, between a folded position and an downwardly extended position; and wherein the bottom seat portion includes at least one bearing seat for receiving each of the transverse crossbars pivotally positioned therein, and wherein each of the leg assemblies includes at least one bearing member to be removably attached to the at least one bearing seat to thereby form a bearing support to each of the U-shaped components.

2. The foldable bath seat as defined in claim 1 wherein each of the bearing members comprises an elastically deformable locking member for locking the bearing member together with the bearing seat.

3. The foldable bath seat as defined in claim 1 wherein each of the legs comprises a slidable extension for height adjustment of the foldable bath seat.

4. The foldable bath seat as defined in claim 1 wherein the seat member comprises a pair of hand grips concealed beneath the top seat portion and integrated with the bottom seat portion of the seat member.

5. The foldable bath seat as defined in claim 1 wherein the seat member is configured with at least a central area of the top seat portion having a convex profile in a longitudinal side view of the bath seat and having a concave profile in a front elevational view of the bath seat.

6. The foldable bath seat as defined in claim 1 further comprising:

a backrest having a front portion and a rear portion; and a backrest support removably attached to the seat member and pivotally connected to the backrest to allow the backrest to pivot between a folded position and an upwardly extended position.

7. The foldable bath seat as defined in claim 6 wherein the backrest support comprises a base portion attached to the bottom seat portion and a rear portion integrated with the base portion and extending upwardly at the rear of the seat member, the rear portion being pivotally connected with the backrest by a pivotal pin.

8. The foldable bath seat as defined in claim 7 wherein the base portion of the backrest support defines at least one opening for receiving the transverse crossbar of one leg assembly mounted to the seat member at the rear, extending therethrough.

9. The foldable bath seat as defined in claim 7 wherein the backrest comprises an elastically deformable lock mechanism for releaseably engaging the rear portion of the backrest support, thereby locking the backrest in the upwardly extended position.

10. The foldable bath seat as defined in claim 6 wherein the backrest comprises an integrated hand grip.

11. A foldable bath seat comprising:

a seat member integrally having a top seat portion and a bottom seat portion, extending longitudinally between a front and a rear and extending transversely between opposed sides of the seat member, the seat member being configured with at least a central area of the top seat portion having a convex profile in a longitudinal side view of the bath seat and having a concave profile in a front elevational view of the bath seat;

first and second leg assemblies pivotally mounted to the seat member at the respective front and rear of the seat member, each leg assembly including two legs pivotable about a transverse pivoting axis, between a folded position and an downwardly extended position;

a backrest having a front portion and a rear portion, the backrest being pivotally mounted to the rear of the seat member to pivot between an upwardly extended position and a folded position.

12. The foldable bath seat as defined in claim 11 wherein the bottom seat portion is integrated with a plurality of reinforcing ribs.

13. The foldable bath seat as defined in claim 12 wherein rear portion of the backrest is integrated with a plurality of reinforcing ribs.

14. The foldable bath seat as defined in claim 12 wherein each of the legs of the respective leg assemblies comprises a slidable leg extension.

15. The foldable bath seat as defined in claim 12 comprising a height dimension in a fully folded condition equal to or less than 20 cm.

16. The foldable bath seat as defined in claim 12 wherein the seat member comprises a pair of hand grips at the respective opposed sides of the seat member concealed beneath the top seat portion and integrated with the bottom seat portion.

17. The foldable bath seat as defined in claim 12 further comprising a soap dish selectively attached to the seat member.

18. The foldable bath seat as defined in claim 12 further comprising a pair of armrests selectively attached to the seat member.

* * * * *